US005098325A

United States Patent [19]

Kim et al.

[11] Patent Number: 5,098,325

[45] Date of Patent: Mar. 24, 1992

[54] PERSONAL, SELF-CONTAINED INFLATABLE FLOTATION APPARATUS

[76] Inventors: Sunyong Kim, 105 Valley Forge, St. Charles, Mo. 63303; Dae W. Lee, 1575 N. Warson Rd., St. Louis, Mo. 63132

[21] Appl. No.: 532,386

[22] Filed: Jun. 4, 1990

[51] Int. Cl.[5] ..... B63H 21/10

[52] U.S. Cl. ..... 441/88; 441/92

[58] Field of Search ..... 441/80, 88, 90-94, 441/96, 98, 99, 101, 106, 108, 113, 122, 123, 131, 40

[56] References Cited

U.S. PATENT DOCUMENTS

| | | | |
|---|---|---|---|
| 1,811,847 | 6/1931 | Hellrich | 441/96 |
| 3,449,777 | 6/1969 | Hattori | 441/94 |
| 4,094,028 | 6/1978 | Fujiyama et al. | 9/321 |
| 4,629,436 | 12/1986 | Stewart et al. | 441/93 |
| 4,850,912 | 7/1989 | Koyanagi | 441/40 |
| 4,887,987 | 12/1989 | Kato | 441/96 |

FOREIGN PATENT DOCUMENTS

| | | | |
|---|---|---|---|
| 0223321 | 5/1987 | European Pat. Off. | 441/92 |
| 0090494 | 4/1988 | Japan | 441/123 |

*Primary Examiner*—Ed. Swinehart

*Attorney, Agent, or Firm*—Senniger, Powers, Leavitt & Roedel

[57] ABSTRACT

A personal inflatable flotation apparatus comprising a flotation unit and an enclosure for the flotation unit. The flotation unit comprises an inflatable flotation bladder of sufficient size to provide flotation support to the user; a cannister of compressed gas for inflating the bladder; and an inflation valve connecting the bladder and the cannister, which when actuated releases the gas from the cannister to inflate the bladder. The enclosure comprises at least first and second enclosure members that interfit to form an enclosure for the flotation unit. The first enclosure member comprises a generally cylindrical hollow member, and the second enclosure member comprises a closure for the first enclosure member. A portion of the flotation unit is attached to the first enclosure member so that as the first and second members are separated the flotation unit is pulled from the first enclosure member. The flotation unit including a lanyard attached to the first enclosure member for automatically actuating the inflation valve when the flotation unit is removed from the enclosure.

16 Claims, 2 Drawing Sheets

PERSONAL, SELF-CONTAINED INFLATABLE FLOTATION APPARATUS

BACKGROUND OF THE INVENTION

This invention relates to flotation equipment, and in particular to a personal, self-contained inflatable flotation apparatus.

Conventional flotation equipment is typically bulky and/or uncomfortable to wear. Some people also find it unattractive or embarrassing to wear. Inflatable flotation equipment also suffers from these same difficulties, moreover they are generally complicated and expensive. For these reasons, many people go without adequate flotation protection when engaging in water sports and boating. What has been needed is a compact, unobtrusive personal flotation apparatus that is neither bulky nor uncomfortable to wear. The apparatus should be simple and easy to operate, particularly in an emergency. Moreover, the apparatus should not be unattractive. Finally, the apparatus should be compact and unobtrusive, to prevent embarrassment and to encourage its use.

SUMMARY OF THE INVENTION

It is among the objects of the present invention to provide a personal, self-contained flotation apparatus; to provide such an apparatus that can be conveniently worn or carried without discomfort or embarrassment; to provide such an apparatus that is easy to use; and to provide such an apparatus that is of simple, inexpensive, and reliable construction. It is also among the objects of this invention to provide such an apparatus that is extremely compact so that it can fit in a pocket or be worn as a pendant around one's neck, to encourage its use.

Generally, the personal flotation apparatus of the present invention comprises an inflatable flotation bladder of sufficient size to provide flotation support to the user, a canister of compressed gas for inflating the bladder, and an inflation valve, connecting the bladder and the canister, which when actuated releases the gas from the canister to inflate the bladder. The apparatus further comprises first and second enclosure members that interfit to form an enclosure for the bladder, the canister, and the inflation valve. The apparatus also includes means for actuating the inflation valve when the bladder, the canister, and the inflation valve are removed from the enclosure to automatically inflate the bladder.

The means for actuating the inflation valve may comprise a lanyard extending from the inflation valve, which when pulled actuates the valve. The end of this lanyard can be attached to the first enclosure member so that as the flotation member, the canister, and inflation valve are removed from the enclosure members, the lanyard actuates the inflation valve. Some portion of at least the bladder, the canister, or the inflation valve is attached to the second enclosure member so that separation of the enclosure members frees the bladder from the enclosure and actuates the inflation valve to inflate the bladder. Preferably, the canister is attached to the second enclosure member.

The first enclosure member preferably comprises a generally cylindrical hollow member with an open end, and the second enclosure member comprises a closure for the open end of the first enclosure member. Together the enclosure members form a small compact enclosure that can fit into a pocket, or a loop may be provided on one of the enclosure members so that the apparatus may be worn around one's neck.

Thus, the invention provides a personal, self-contained flotation apparatus. Because the apparatus is inflatable, it is compact, and can be conveniently worn or carried without discomfort or embarrassment. The apparatus can be made so compact that it can easily be carried in a pocket, or when provided with a loop, worn around one's neck. The apparatus is extremely simple and easy to use—removing the inflatable bladder from the enclosure by separating the enclosure members automatically causes the bladder to inflate. The apparatus is of simple, and inexpensive, and reliable construction.

These and other features and advantages will be in part apparent and in part pointed out hereinafter.

BRIEF DESCRIPTION OF THE DRAWINGS

Corresponding reference numerals indicate corresponding parts throughout the several views of the drawings.

DETAILED DESCRIPTION OF THE PREFERRED EMBODIMENT

Figure 1:
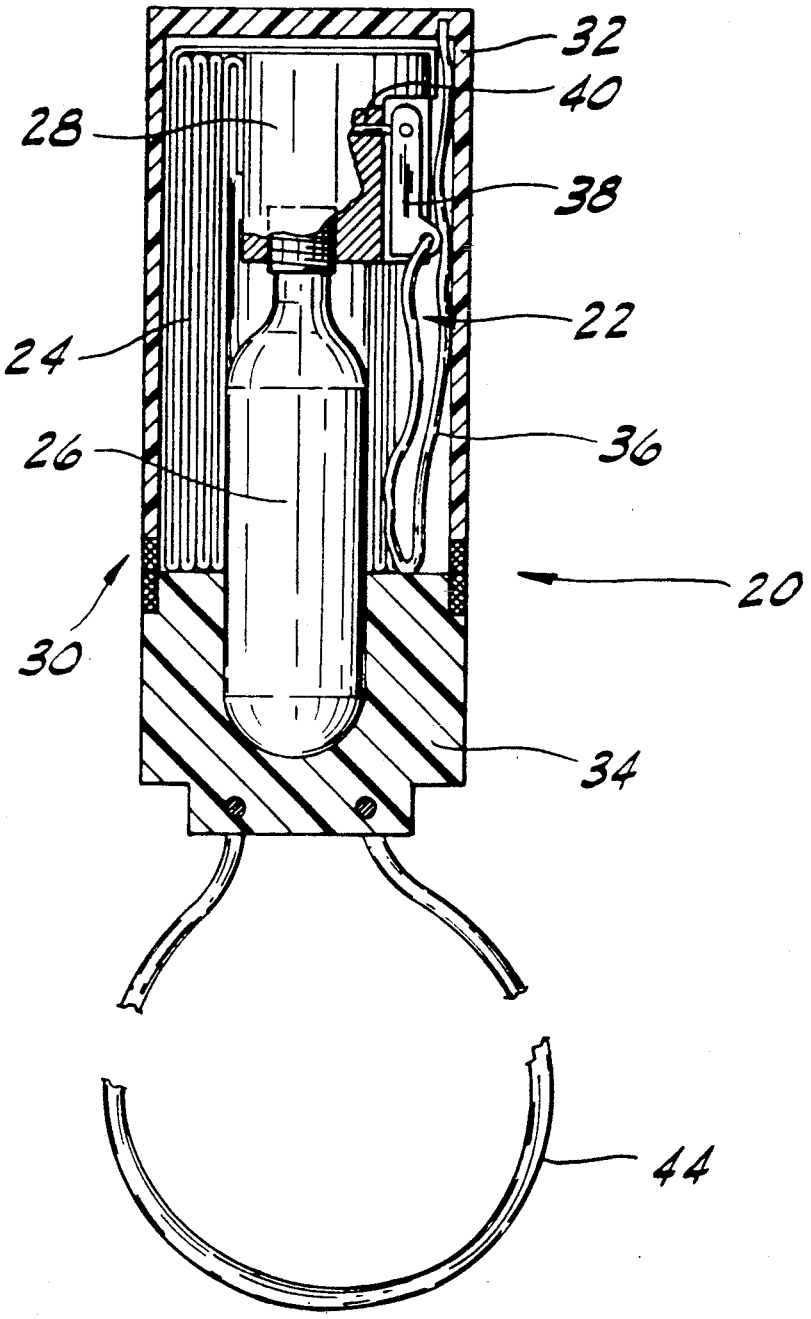
FIG. 1 is a vertical cross-sectional view through the enclosure of a personal inflatable flotation apparatus constructed according to the principles of this invention, before inflation.
Figure 2:
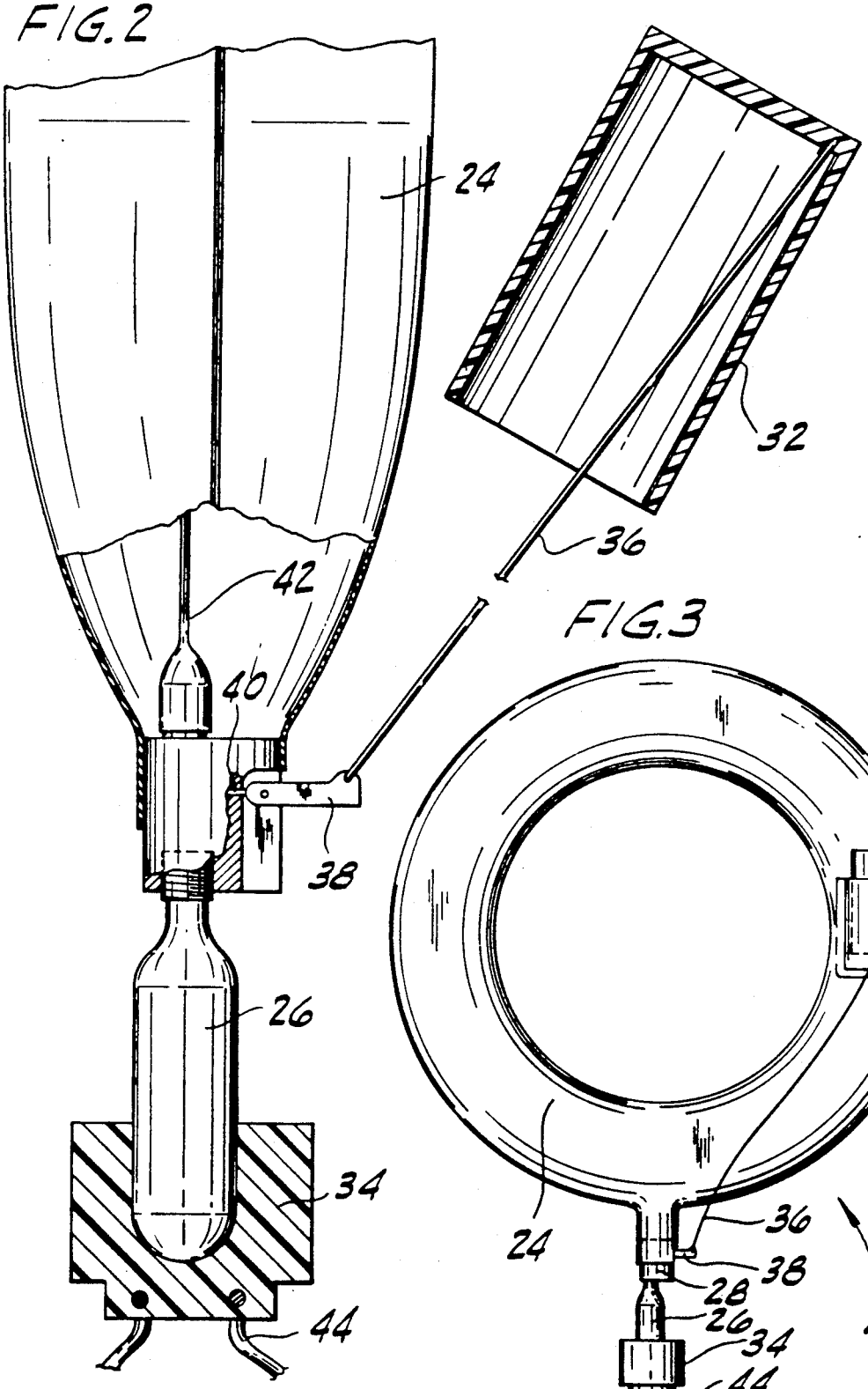
FIG. 2 is a vertical cross sectional view through the enclosure of the personal inflatable flotation apparatus of FIG. 1, after inflation.
Figure 3:
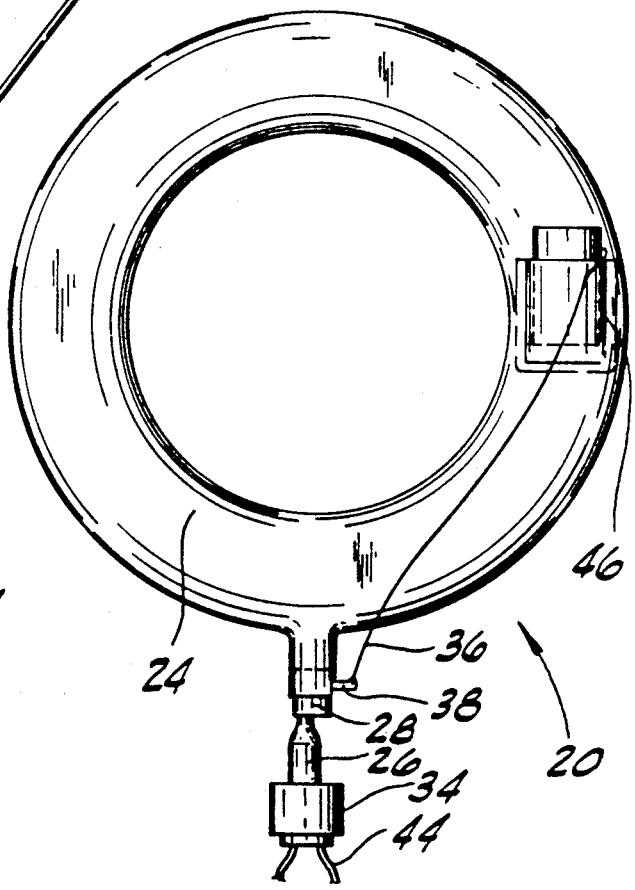
FIG. 3 is a top plan view of the personal inflatable flotation apparatus in FIG. 2.

A personal, self-contained inflatable flotation apparatus constructed according to the principles of this invention is indicated generally as 20 in FIGS. 1-3. The apparatus comprises a flotation unit 22 which comprises an inflatable flotation bladder 24 of sufficient size to provide flotation support to the user; a canister 26 of compressed gas for inflating the bladder; and an inflation valve 28 connecting the bladder 24 and the canister 26, and which when actuated releases the gas from the canister to inflate the bladder. The bladder 24 may be made from any suitable thin walled, flexible rubber or plastic material, for example polyester film. The bladder 24 can be any shape, but the traditional life preserver "donut" shape is preferable because it takes up less space in its deflated state and permits the user to climb into the middle for easier handling and flotation. When fully inflated, the bladder 24 preferably has a maximum diameter of from 20 to 36 inches, depending on the size of the person for which it is designed.

The bladder 24 and the inflation valve 28 can be joined by heat welds. The canister 26 and the inflation valve 28 can be threadedly connected.

The apparatus 20 further comprises an enclosure 30 comprising at least first and second enclosure members 32 and 34 that interfit to form an enclosure for the flotation unit. As depicted in FIG. 1, in a preferred embodiment, the first and second enclosure members 32 and 34 are disposed in axial alignment with one another along a longitudinal axis of the apparatus each with an end disposed adjacent an end of the other, so that they form respective portions of a unit fully enclosing the bladder, the canister, and the inflation valve. The enclosure members may be attached simply by a friction fit, they may be threaded together to allow the units to be twisted together and apart, or some other means of joinder may be utilized. Such conventional interfitting mechanisms for forming an enclosure of members 32 and 34 are symbolically illustrated in FIG. 1 by the cross-hatched portions of enclosures members 32 and 34. The apparatus 20 further comprises means for automatically actuating the inflation valve 28 when the flotation unit 22 is removed from the enclosure 30. Preferably, the inflation valve 28 is of the type that can be actuated by pulling a lanyard 36. For example as shown in FIG. 2, the inflation valve 28 can include a pivotally mounted arm 38 that opens a gate 40. The lanyard 36 is connected to the arm 38, and pulling on the lanyard 36 pulls the arm to open the inflation valve and release gas into the bladder. Of course, inflation valve 28 could have some other construction. The end of the lanyard 36 is attached to the first enclosure member 32, so that as the flotation unit is removed from the enclosure, and is pulled from the first closure member, the lanyard actuates the inflation valve 28 to inflate the bladder.

A one-way valve means may be associated with the inflation valve 28 to prevent the bladder from deflating once it is inflated. This also allows the canister 26 to be removed from the inflation valve after inflation is complete. This one way valve means might be, for example, a flattened tube 42, composed of a flexible material such as a soft plastic. The pressure exerted by the gas entering the bladder 24 forces the tube 42 to remain open. However, once the flow of gas from the canister 26 stops, the tube 42 collapses on itself, preventing gas from escaping from the bladder.

A portion of the flotation unit 20, e.g., the bladder 24, the canister 26, or the inflation vale 28, is preferably attached to the second enclosure member so that separation of the first and second enclosure members 32 and 34 frees the flotation unit 22 from the enclosure and actuates the inflation valve 28 to inflate the bladder 24. Preferably, the canister 26 is attached to the second enclosure member 34.

The first enclosure member preferably 32 comprises a generally cylindrical hollow member with an open end. The second enclosure member 34 comprises a closure member for the end of the first enclosure member. The enclosure is preferably sized so that it can fit in a pocket. The entire enclosure 30 preferably has a diameter of about ¾ to about 2 inches and a length of from about 5 to about 7 inches in order to minimize bulk. The bladder is sized and configured so that it can be folded tightly into the enclosure. The second enclosure member 34 can be provided with a loop 44 for convenient storage and handling of the apparatus, and so that the apparatus can be worn around one's neck like a pendant. The enclosure can be made in a variety of colors, shapes and decorative designs tailored to the particular age group or taste of the individual user.

The bladder may include an exterior pocket 46 for receiving the canister and the inflation valve of the first enclosure member after the bladder is inflated.

OPERATION

The apparatus 20 can be conveniently carried or worn by anyone engaging in water sports or boating. Because of its compact size, it is not uncomfortable. Moreover, the device can be disguised as a pendant, reducing embarrassment and encouraging use. In an emergency, the apparatus provides a personal flotation device. The user simply completely separates the first and second enclosure members 32 and 34. This can be easily done by simply pulling on the first enclosure member 32. The separation of the first and second members 32 and 34 tends to pull the flotation unit 22 out of the first enclosure member. As the flotation unit is pulled out of the first enclosure member, the lanyard 36 is pulled, actuating the inflation valve 28 and inflating the bladder 24. The apparatus may include a one-way valve means that prevents the bladder from deflating. The first enclosure member 34 can be discarded, or tucked into pocket 46 provided for that purpose on the exterior of the bladder. Likewise, the canister can either be discarded, or tucked into a pocket provided for that purpose.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A personal inflatable flotation apparatus comprising:

an inflatable flotation bladder of sufficient size to provide flotation support to the user;

a canister of compressed gas for inflating the bladder;

an inflation valve connecting the bladder and the canister, which when actuated releases the gas from the canister to inflate the bladder;

first and second enclosure members, said enclosure members being disposed in axial alignment with one another along a longitudinal axis of the apparatus, each with an end disposed adjacent an end of the other, so that they interfit to form respective portions of an enclosure fully enclosing the bladder, the canister, and the inflation valve; and a lanyard extending from the inflation valve, which when pulled actuates the valve, the end of the lanyard being attached to the first enclosure member so that as the flotation member, the canister, and inflation valve are removed from the enclosure, the lanyard actuates the inflation valve.

2. The apparatus according to claim 1 wherein a portion of at least the bladder, the canister, or the inflation valve is attached to the second enclosure member so that complete separation of the enclosure members frees the bladder from the enclosure and actuates the inflation valve to inflate the bladder.

3. The apparatus according to claim 2 wherein the canister is attached to the second enclosure member.

4. The apparatus according to claim 2 wherein the first enclosure member comprises a generally hollow member with an open end, and wherein the second enclosure member comprises a closure for the open end of the first enclosure member.

5. The apparatus according to claim 1 further comprising one-way valve means associated with the inflation valve comprising a tube composed of a flexible material attached to the valve inside the bladder that allows gas to enter the bladder but collapses on itself when gas flow stops, thereby preventing gas from escaping from the bladder.

6. The apparatus according to claim wherein the bladder further comprises an exterior pocket for receiving the canister and the inflation valve after the bladder is inflated.

7. The apparatus according to claim 1 further comprising a loop attached to one of the enclosure members so that the apparatus can be worn around one's neck.

8. A personal inflatable flotation apparatus comprising:

a flotation unit comprising: an inflatable flotation bladder of sufficient size to provide flotation support to the user; a canister of compressed gas for inflating the bladder; and an inflation valve connecting the bladder and the canister, which when actuated releases the gas from the canister to inflate the bladder; and an enclosure comprising at least first and second enclosure members, said enclosure members being disposed in axial alignment with one another along a longitudinal axis of the apparatus, each with an end disposed adjacent an end of another enclosure member, so that the enclosure members interfit to form respective portions of an enclosure fully enclosing the flotation unit, the flotation unit including means for automatically actuating the inflation valve when the flotation unit is removed from the enclosure.

9. The apparatus according to claim 8 wherein the means for actuating the inflation valve comprises a lanyard extending from the inflation valve, which when pulled actuates the valve, the end of the lanyard being attached to the first enclosure member so that as the flotation unit is removed from the enclosure, the lanyard actuates the inflation valve to inflate the bladder.

10. The apparatus according to claim 8 wherein the canister is attached to the second enclosure member.

11. The apparatus according to claim 8 wherein the first enclosure member comprises a generally hollow member with an open end, and wherein the second enclosure member comprises a closure member for the open end of the first enclosure member.

12. The apparatus according to claim 8 further comprising one-way valve means associated with the inflation valve comprising a tube composed of a flexible material attached to the valve inside the bladder that allows gas to enter the bladder but collapses on itself when gas flow stops, thereby preventing gas from escaping from the bladder.

13. The apparatus according to claim 8 further comprising a loop attached to the first enclosure member so that the apparatus can be worn around one's neck.

14. A personal inflatable flotation apparatus comprising:

a flotation unit comprising: an inflatable flotation bladder of sufficient size to provide flotation support to the user; a canister of compressed gas for inflating the bladder; and an inflation valve connecting the bladder and the canister, which when actuated releases the gas from the canister to inflate the bladder; and an enclosure comprising at least first and second enclosure members, said enclosure members being disposed in axial alignment with one another along a longitudinal axis of the apparatus, each with an end disposed adjacent an end of another enclosure member, so that the enclosure members interfit to form respective portions of an enclosure fully enclosing the flotation unit, the flotation unit including means for automatically actuating the inflation valve when the flotation unit is removed from the enclosure, wherein a portion of the flotation unit is attached to the second enclosure member so that complete separation of the first and second enclosure members frees the flotation unit from the enclosure and actuates the inflation valve to inflate the bladder.

15. A personal inflatable flotation apparatus comprising:

a flotation unit comprising: an inflatable flotation bladder of sufficient size to provide flotation support to the user; a canister of compressed gas for inflating the bladder; and an inflation valve connecting the bladder and the canister, which when actuated releases the gas from the canister to inflate the bladder; and an enclosure comprising at least first and second enclosure members, said enclosure members being disposed in axial alignment with one another along a longitudinal axis of the apparatus, each with an end disposed adjacent an end of another enclosure member, so that the enclosure members interfit to form respective portions of an enclosure fully enclosing the flotation unit, the flotation unit including means for automatically actuating the inflation valve when the flotation unit is removed from the enclosure, wherein the bladder further comprises an exterior pocket for receiving the canister and the inflation valve after the bladder is inflated.

16. A personal inflatable flotation apparatus comprising:

a flotation unit comprising: an inflatable flotation bladder of sufficient size to provide flotation support to the user; a canister of compressed gas for inflating the bladder; and an inflation valve connecting the bladder and the canister, which when actuated releases the gas from the canister to inflate the bladder; and an enclosure comprising at least first and second enclosure members that interfit to from an enclosure for the flotation unit, the first enclosure member comprising a generally cylindrical hollow member with an open end, and the second enclosure member comprising a closure for the open end of the first enclosure member, a portion of the flotation unit being attached to the second enclosure member so tat as the first and second members are separated the flotation unit is pulled from the first enclosure member;

the flotation unit including a lanyard extending from the inflation valve, which when pulled actuates the valve the end of the lanyard being attached to the first enclosure member so that as the flotation unit is removed from the enclosure, the lanyard actuates the inflation valve to inflate the bladder.

* * * * *